US006516164B1

(12) United States Patent
Kawazu

(10) Patent No.: US 6,516,164 B1
(45) Date of Patent: Feb. 4, 2003

(54) EXCESSIVE TEMPERATURE RISING PREVENTION DEVICE, HEATING APPARATUS AND FIXING APPARATUS

(75) Inventor: Takao Kawazu, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/642,092

(22) Filed: Aug. 21, 2000

(30) Foreign Application Priority Data

Aug. 23, 1999 (JP) ..... 11-235111

(51) Int. Cl.[7] ..... G03G 15/20; H05B 1/00; H01H 37/52

(52) U.S. Cl. ..... 399/69; 219/216; 337/333

(58) Field of Search ..... 399/69, 320, 328, 399/329, 330, 331, 332, 333, 334; 219/216; 337/16, 111, 112, 333, 365

(56) References Cited

U.S. PATENT DOCUMENTS 4,027,385 A * 6/1977 Duebel ..... 337/112 X
4,039,992 A * 8/1977 Givler ..... 337/365
5,444,521 A * 8/1995 Tomoyuki et al. ..... 399/335
5,576,683 A * 11/1996 Rose ..... 337/333
6,075,228 A * 6/2000 Goto et al. ..... 399/69 X

* cited by examiner

*Primary Examiner*—Hoan Tran
(74) *Attorney, Agent, or Firm*—Fitzpatrick, Cella, Harper & Scinto

(57) ABSTRACT

A thermostatic device has a temperature detecting portion for detecting temperature, the portion including a bimetal and a heat conductive cap for covering the bimetal, and an opening/closing portion for opening and closing electric contact point in accordance with an operation of the temperature detecting portion, and the opening/closing portion is extended long, and a length of the opening/closing portion in the longitudinal direction is greater than a length of the heat conductive cap in the same longitudinal direction.

24 Claims, 9 Drawing Sheets

EXCESSIVE TEMPERATURE RISING PREVENTION DEVICE, HEATING APPARATUS AND FIXING APPARATUS

BACKGROUND OF THE INVENTION

1. Field of the Invention

The present invention relates to a fixing apparatus for an image forming apparatus, such as a copier or a printer, and relates in particular to an excessive temperature rising prevention device, for preventing an excessive increase in temperature in a heating apparatus used for fixing.

2. Related Background Art

A conventional image forming apparatus employing an electrophotographic process will now be described.

A thermal fixing apparatus, which serves as image heating means for an image forming apparatus, fixes to a recording sheet an unfixed image (a toner image) that is formed thereon by image forming means. Well known thermal fixing apparatuses are a heat roller fixing apparatus that employs a halogen heater as a heating source and a film heating fixing apparatus that employs a ceramic face heater as a heating source.

Generally, the heat generating member of a ceramic heater is provided on the face of an insulating substrate mad e of AlN or $Al_2O_3$ and the like, and generates heat when power is supplied to it. In this case, power control means controls the supply of power based on temperatures detected by a temperature detecting device located above or adjacent to the ceramic heater. Normally, an excessive temperature rising prevention device, for preventing an excessive temperature rising (increase), is also provided in order to prevent the thermal fixing apparatus from entering an excessively high temperature state due to a power control means defect. A thermal fuse or a thermostat is frequently employed as an excessive temperature rising prevention device, for preventing an excessive temperature increase.

Generally, the thermostat comprises: a bimetal; a base member for holding the bimetal; contact points supported by the base member and can be opened and closed; and a cap, which is a thermosensitive face that is attached to the base member and covers the bimetal. The thermostat is substantially circular, having a shape similar to that of the bimetal.

When the thermostat is employed as an excessive temperature rising prevention device of a thermal fixing apparatus that uses a ceramic heater in which a heat generating member is printed on the insulating substrate, and when the thermostat is abutted against the insulating substrate of the ceramic heater, it is preferable that the width of the abutting (contacting) thermosensitive portion be less than that of the insulating substrate, so that the heat of the heater can be effectively sensed and the responsibility improved.

Therefore, when the thermostat is to be brought into contact with the insulating substrate of the ceramic heater, the thermostat having the external size corresponding to the width of the insulating substrate is used. In this case, since the contact points held by the base member must be formed in a small space, a complicated structure is employed to provide a satisfactory contact pressure. Further, in order to provide a satisfactory contact pressure while using a simpler structure, the external size of the thermostat is increased. Thus, it is difficult to thermally efficiently bring the thermostat into contact with the insulating substrate of the ceramic heater.

SUMMARY OF THE INVENTION

It is, therefore, one objective of the present invention to provide an excessive temperature rising prevention device that can certainly open and close contact point portion without losing the thermal responsibility on a temperature detecting portion, and a heating apparatus and a fixing apparatus that employ the device.

It is another objective of the present invention to provide an excessive temperature rising prevention device comprising: a temperature detecting portion for detecting temperature and an opening/closing portion for opening and closing electric contact point in accordance with the operation of the temperature detecting portion, wherein the opening/closing portion is extended long, and the length of the opening/closing portion in the longitudinal direction is greater than the width of the temperature detecting portion in the direction; and to provide a heating apparatus and a fixing apparatus employing the excessive temperature rising prevention device.

Other objectives will become obvious during the course of the following explanation given for the preferred embodiments.

DETAILED DESCRIPTION OF THE PREFERRED EMBODIMENTS

The preferred embodiments of the present invention will now be described while referring to the accompanying drawings.

Figure 1:
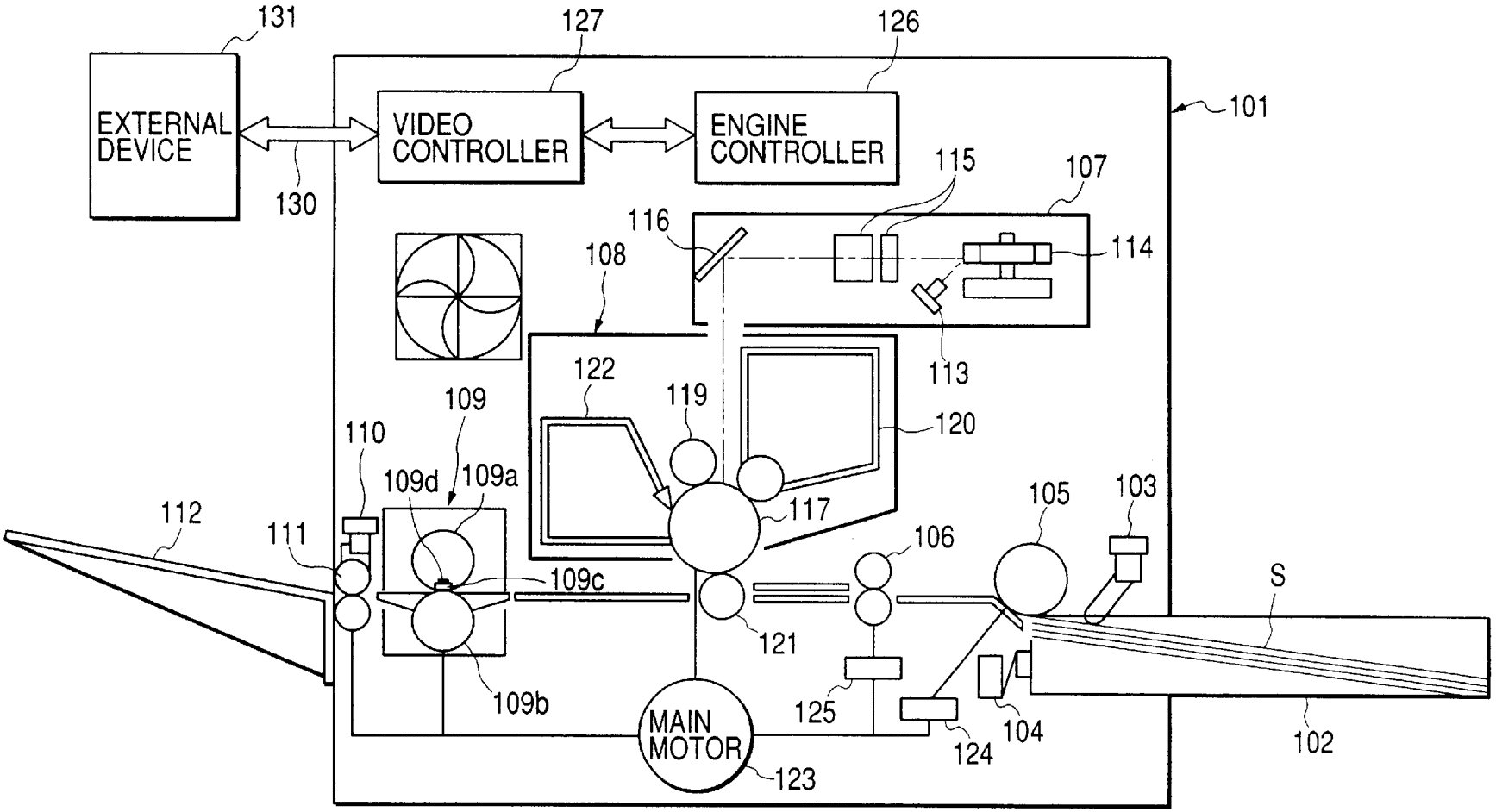
FIG. 1 is a schematic cross-sectional view of an image forming apparatus (a laser printer) according to the present invention.

FIG. 1 is a schematic cross-sectional view of a laser printer, an image forming apparatus that uses an electrophotographic process.

In a main body 101 of the laser printer according to the present embodiment, provided are: a cassette 102 in which recording sheets S, which constitute recording material, are stored; a cassette presence/absence sensor 103 for detecting the presence or absence of the recording sheets S in the cassette 102; a cassette size sensor (constituted by a plurality of macro switches) 104 for detecting the size of the recording sheets S in the cassette 102; a sheet feeding roller 105 for feeding the recording sheets S from the cassette 102 and the like. A registration roller pair 106 is provided downstream of the sheet feeding roller 105 to synchronously convey the recording sheets S.

An image forming unit 108, for forming toner images on the recording sheet S based on a laser beam emitted from a laser scanner portion 107, is provided downstream of the registration roller pair 106. A fixing apparatus 109 for thermally fixing toner images formed on the recording sheet S, is provided downstream of the image forming unit 108. Also provided downstream of the fixing apparatus 109 are: a sheet discharging sensor 110, for detecting the conveying state of a sheet discharging portion; a sheet discharging roller 111 for discharging recording sheets S; and a stacked tray 112 for stacking recording sheets S for which recording has been completed. The reference for the conveying of the recording sheet S is set at the center of the sheet S length (i.e., a width of the recording sheet S) in a direction perpendicular to the direction in which the image forming apparatus conveys the recording sheets S.

The laser scanner 107 includes: a laser unit 113 for emitting a laser beam modulated on the basis of an image signal (VDO) that is transmitted by an external device 131, which will be described later; a polygon mirror 114 for scanning a photosensitive drum 117, which will be described later, with the laser beam from the laser unit 113; an imaging lens 115; a return mirror 116 and the like.

The image forming unit 108 includes the photosensitive drum 117, which is required for the well known electrophotographic process, a primary charging roller 119, a developing apparatus 120, a transferring charging roller 121, and a cleaner 122. The fixing apparatus 109 includes a fixing film 109*a,* a pressure roller 109*b,* a ceramic heater 109*c* provided in the fixing film 109*a,* a thermistor 109*d* for detecting the surface temperature of the ceramic heater 109*c,* and the like.

A main motor 123 exerts a driving force, via a sheet feeding roller clutch 124, to the sheet feeding roller 105 and also exerts a driving force, via a registration roller clutch 125, to the registration roller pair 106. Further, the main motor 123 exerts a driving force to each unit of the image forming portion 108, including the photosensitive drum 117, the fixing apparatus 109 and the sheet discharging rollers 111.

An engine controller 126 controls the electrophotographic process performed by the laser scanner portion 107, the image forming portion 108 and the fixing apparatus 109, and the conveying of the recording sheets S in the main body 101.

A video controller 127 is connected, via a general-purpose interface, such as a centronics or an RS232C interface, to the external device 131, such as a personal computer. The video controller 127 expands image information sent from the general-purpose interface 130 into bit map data, and transmits the bit map data, as a VDO signal, to the engine controller 126.

Figure 2:
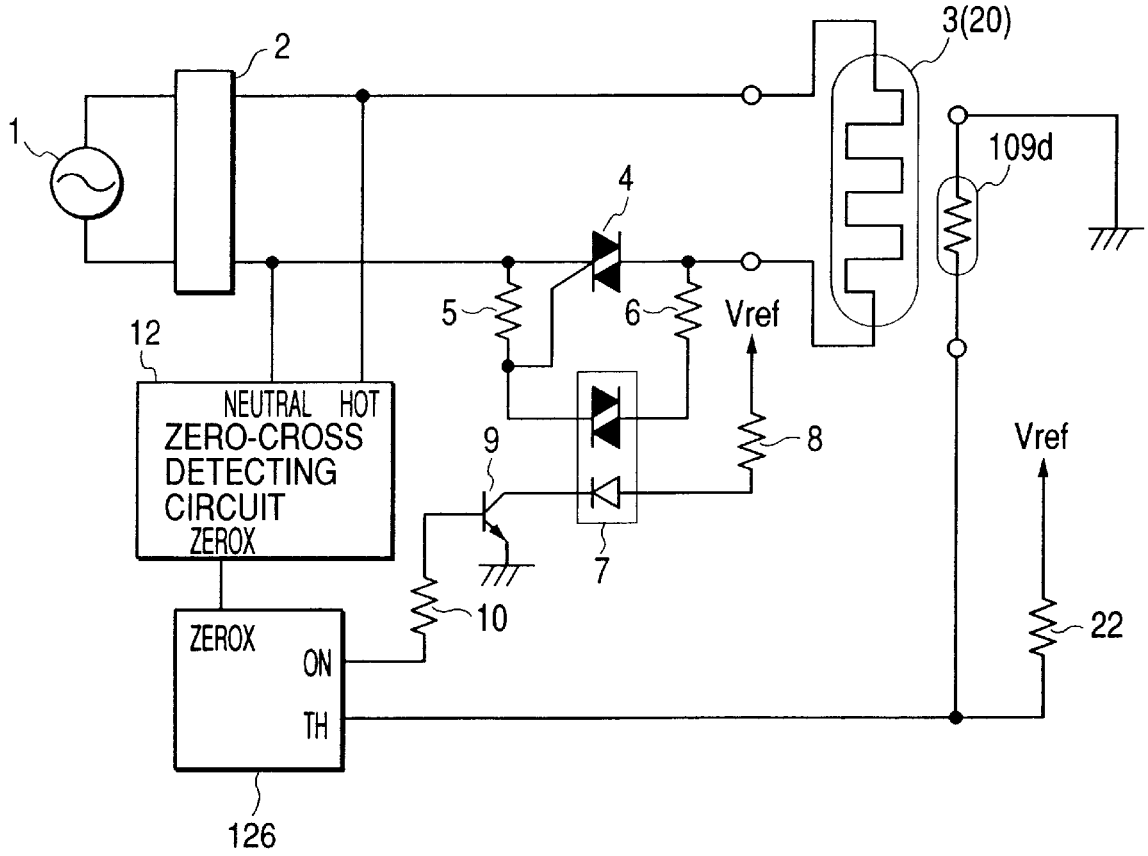
FIG. 2 is a drive circuit diagram showing a fixing apparatus for the image forming apparatus according to the present invention.

FIG. 2 is a diagram showing a circuit for driving and controlling the ceramic heater 109*c* of the fixing apparatus 109.

In FIG. 2, an AC power source 1 is connected to the image forming apparatus. The image forming apparatus supplies commercially available power, via an AC filter 2, to a heat generating body 3 or 20 (see FIGS. 3A, 3B and 4) of the ceramic heater 109*c* in order to heat the heat generating body 3 or 20. The supply of power to the heat generating body 3 is turned on or off by a triac 4. Resistances 5 and 6 are bias resistances for the triac 4, and a photo-triac-coupler 7 is a device for obtaining the distance along between the primary surface and the secondary surface. When the light-emitting diode of the photo-triac-coupler 7 is supplied power, the triac 4 is turned on. A resistance 8 is used to limit the current in the photo-triac-coupler 7, and is turned on or off by a transistor 9. The transistor 9 is operated in accordance with an ON signal received from the engine controller 126 via a resistance 10. Although the circuit for driving and controlling the heat generating body 20 is not shown in FIG. 2, the heat generating body 20, as well as the heat generating body 3, is driven and generates heat.

The commercially available power from the AC power source 1 is supplied, via the AC filter 2, to a zero-cross detecting circuit 12. The zero-cross detecting circuit 12 informs the engine controller 126 of a pulse signal indicating that the commercially available power voltage is equal to or lower than a threshold value. This signal, which is transmitted to the engine controller 126, is hereinafter called a ZEROX signal. The engine controller 126 detects the edge of the pulse of the ZEROX signal, and uses the phase control or the wave-number control to turn on or off the triac 4.

A thermistor 109*d* detects the temperature of the ceramic heater 109*c* in which the heat generating bodies 3 and 20 are formed. The thermistor 109*d* is position, via an insulating material having an insulating voltage-resistance, on the ceramic heater 109*c* so that the insulating distance from the heat generating body 3 or 20 can be obtained. The temperature is detected by the thermistor 109*d* as a divided voltage for a resistance 22 and the thermistor 109*d,* and is A/D-input as a TH signal to the engine controller 126. The temperature of the ceramic heater 109*c* is monitored in the engine controller 126 as a TH signal and, to calculate the power to be supplied to the heat generating body 3 or 20 of the ceramic heater 109*c,* by comparing withe the set temperature of the ceramic heater 109*c.* The obtained power is converted to a phase angle (phase control) or a wave number (wave-number control), and transmits an ON signal to the transistor 9 in accordance with the control condition.

A thermostat 23 (see FIGS. 3A and 3B) is located on the ceramic heater 109*c,* and serves as an excessive temperature rising prevention device if the means for supplying power to the heat generating body 3 or 20 malfunctions and a thermal runaway occurs at the heat generating body 3 or 20. When, due to a malfunction of the power supply means, when a thermal runaway occurs at the heat generating body 3 or 20 and the thermostat 23 has a temperature equal to or greater than a predetermined temperature, the thermostat 23 is opened and the supply of power to the heat generating body 3 or 20 is cut.

Figure 3A:
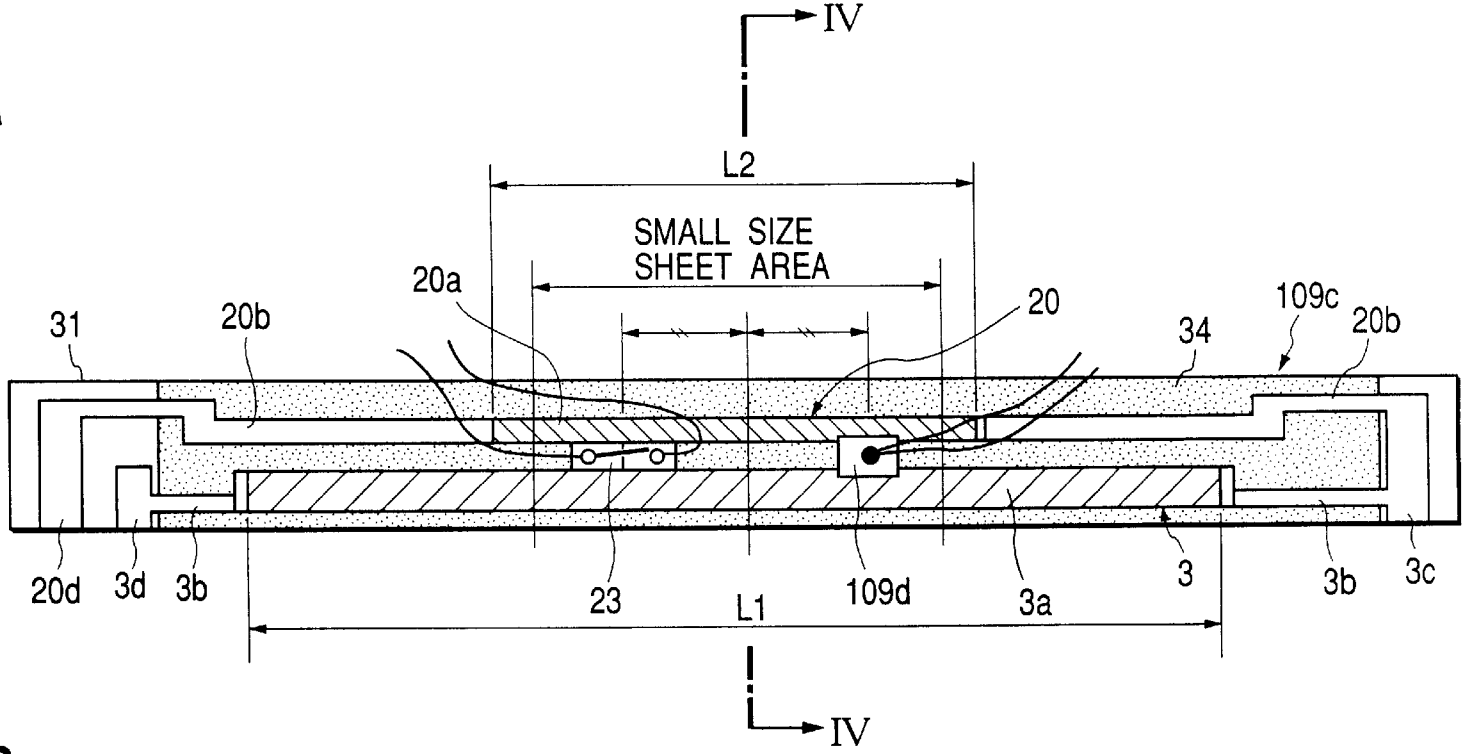
FIG. 3A is a plan view of a ceramic heater, viewed in the direction indicated by an arrow A in FIG. 4.
Figure 3B:
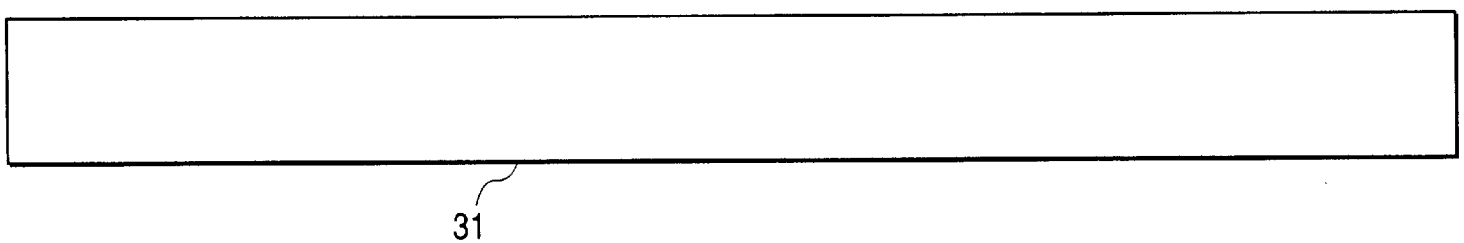
FIG. 3B is a bottom view of the ceramic heater, viewed in the direction indicated by an arrow B in FIG. 4.
Figure 4:
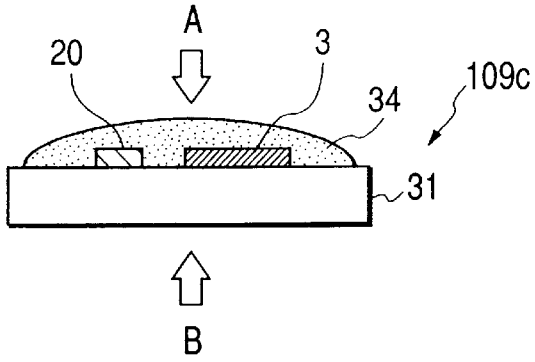
FIG. 4 is an enlarged cross-sectional view of the ceramic heater taken along the line IV—IV in FIG. 3A.

The positional relationship of the ceramic heater 109*c,* the thermistor 109*d* and the thermostat 23 will now be explained while referring to FIGS. 3A, 3B and 4. FIGS. 3A and 3B are a plan view (viewed in the direction indicated by an arrow A in FIG. 4) and a bottom view (viewed in the direction indicated by an arrow B in FIG. 4) of the ceramic heater 109*c* respectively, and FIG. 4 is an enlarged cross-sectional view taken along the line IV—IV in FIG. 3A.

The ceramic heater 109*c* is constituted by a long, insulating substrate 31, composed of ceramics such as SiC, A1N or $A1_2O_3$, the heat generating bodies 3 and 20, which are formed on the insulating substrate 31 using paste printing or the like, and a protective layer 34, composed of glass or the like, for protecting the heat generating bodies 3 and 20. The thermistor 109*d,* which detects the temperature of the ceramic heater 109*c,* and the thermostat 23 are located on the protective layer 34 at symmetrical positions relative tot he reference point for the conveying of a recording sheet S, i.e., relative to the center, in the longitudinal direction, of heat generating portions 3a and 20*a,* and at positions inside the width of the minimum recording sheet width in which sheets can be conveyed. In FIG. 3A, L1 and L2 denote the lengths of the heat generating bodies 3 and 20 respectively.

The heat generating body 3 includes: the heat generating portion 3*a,* for generating heat when the power is supplied; electrodes 3*c* and 3*d* to which power is supplied via connectors; and a conductive portion 3*b,* which connects the electrodes 3*c* and 3*d* to the heat generating portion 3*a.*

The heat generating body 20 includes: a heat generating portion 20*a* for generating heat when the power is supplied; electrodes 3*c* and 20*d,* to which power is supplied via connectors; and a conductive portion 20*b,* which is connected to the electrodes 3*c* and 20*d.* The electrode 3*c,* which is connected to both the heat generating bodies 3 and 20, serves as a common electrode.

A hot AC power source 1 terminal is connected via the thermostat 23 to the common electrode 3*c.* The electrode 3*d* is connected to the triac 4 that controls the heat generating body 3, and the electrode 20*d* is connected to a triac, not shown, that controls the heat generating body 20, and also to the neutral terminal of the AC power source 1.

Figure 5:
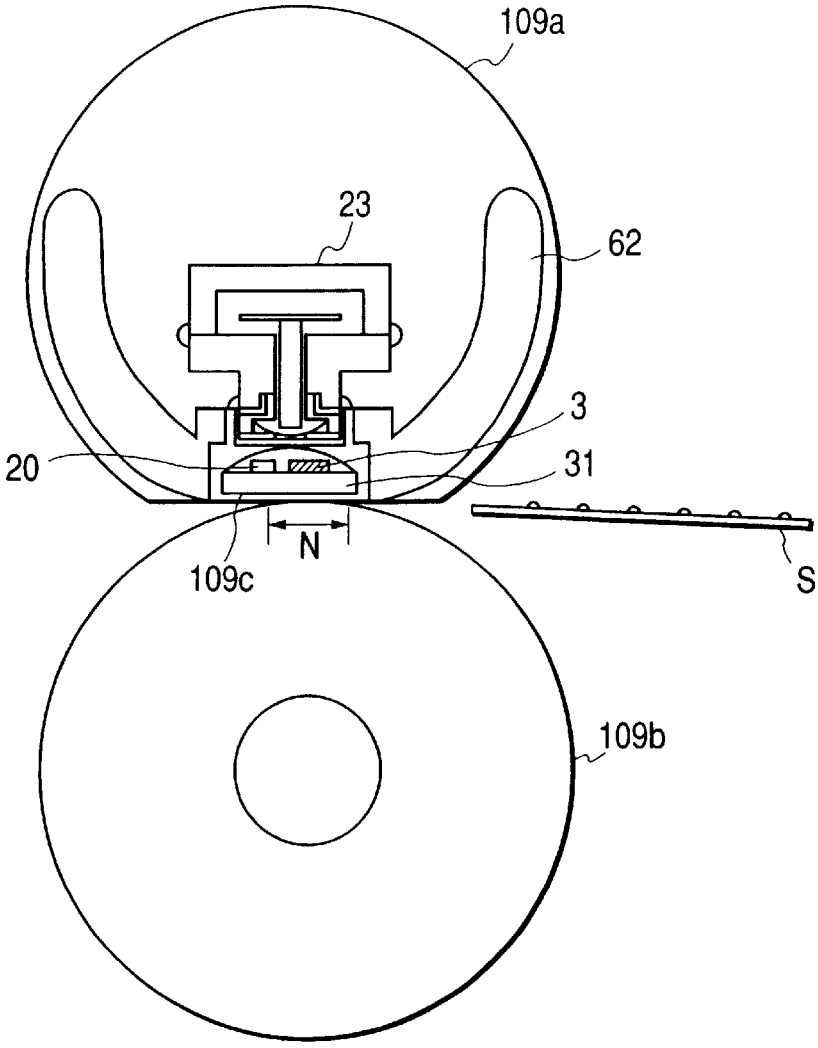
FIG. 5 is a diagram illustrating the fixing apparatus of the image forming apparatus according to the present invention.

As is shown in FIG. 5, the ceramic heater 109*c* is supported by a film guide 62. In FIG. 5, a cylindrical fixing film 109*a,* composed of a heat resistant material, is coupled externally to the film guide 62 that supports on its lower face the ceramic heater 109*c.* Under a predetermined pressure, the pressure roller 109*b* as a pressure member is pressure contacted the ceramic heater 109*c* on the lower face of the film guide 62, with the fixing film 109*a* in between, through the elasticity of the pressure roller 109*b.* As a result, a fixing nip N, having a predetermined width, is formed as a heating portion. One of the faces of the film 109*a* slides with the heater 109*c,* while the other face moves in contact with the recording material bearing the unfixed image, which at the nip N is fixed on the recording material, by the heat from the ceramic heater 109*c* via the film 109*a.*

Figure 6:
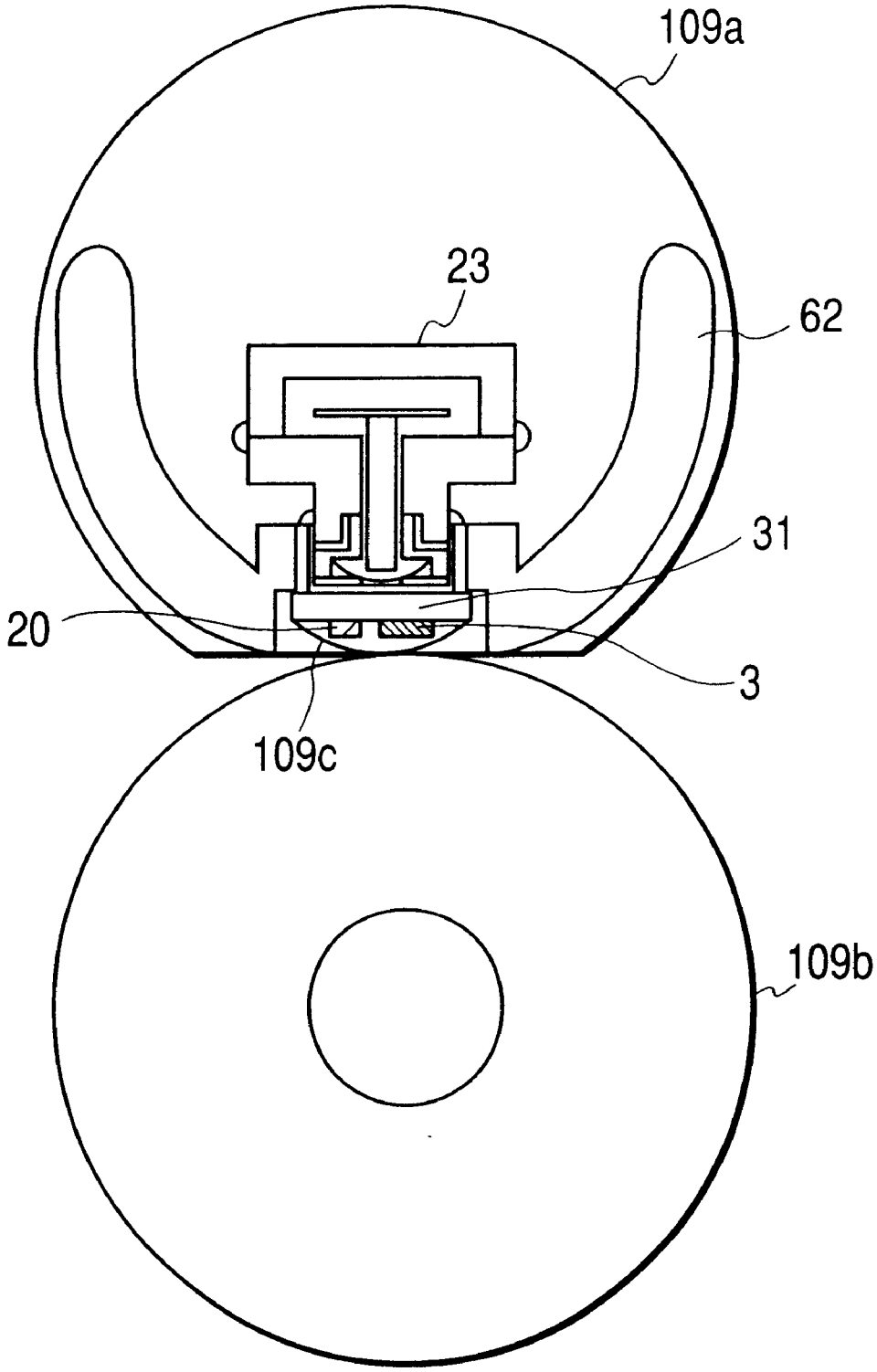
FIG. 6 is a diagram illustrating the fixing apparatus of the image forming apparatus according to the present invention.

The thermostat 23 abuts on the face of the protective layer 34 of the ceramic heater 109*c,* the position of the thermostat 23 is corrected by the film guide 62, and the thermosensitive face contacts the face of the ceramic heater 109*c.* As is shown in FIG. 6, the heat generating bodies 3 and 20 of the ceramic heater 109*c* may be located near the nip. Under these circumstances, the thermostat 23 contacts the face of the insulating substrate 31 of the ceramic heater 109*c.*

Figure 7:
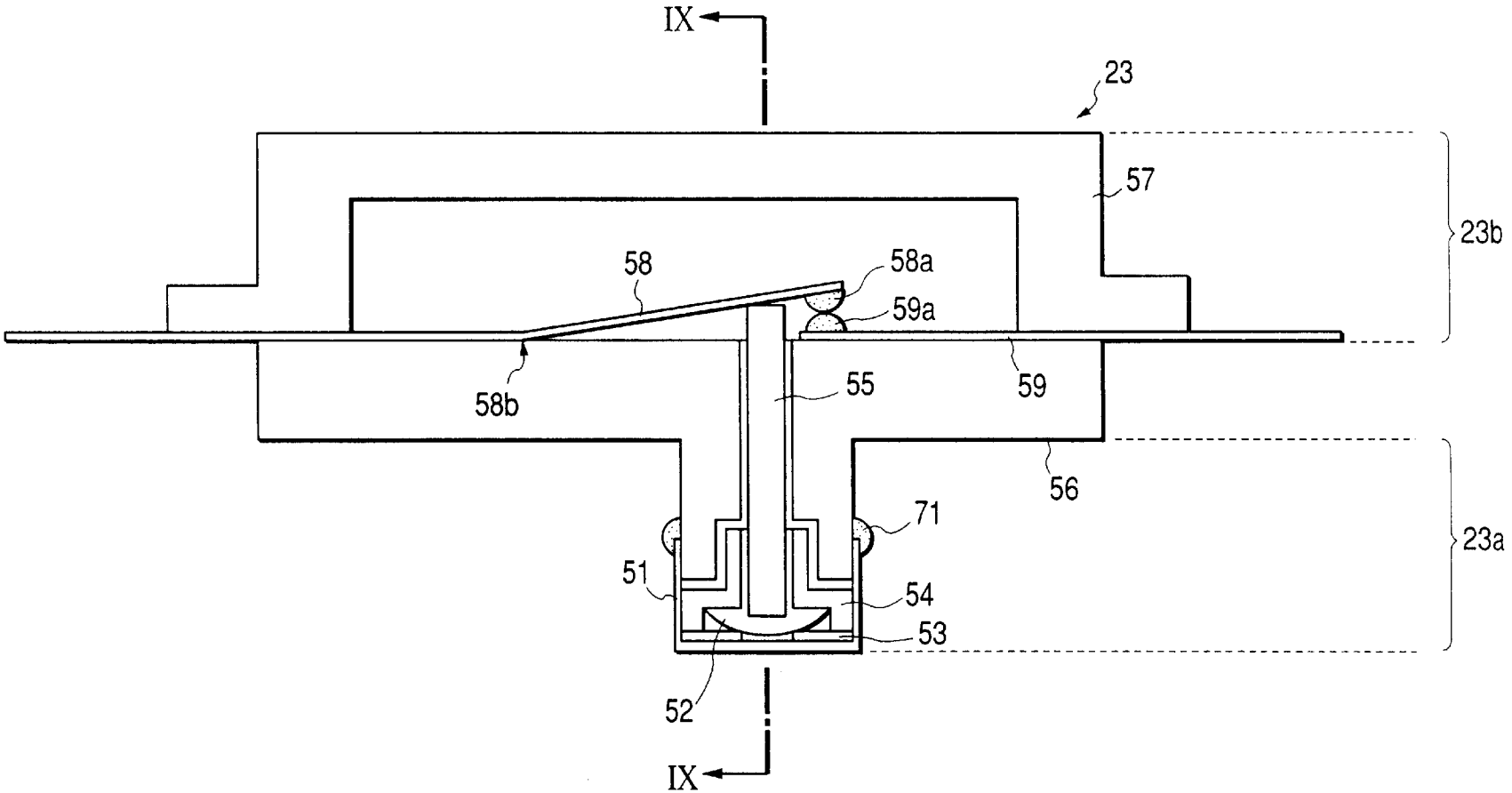
FIG. 7 is a side cross-sectional view of a thermostat according to the present invention.
Figure 8:
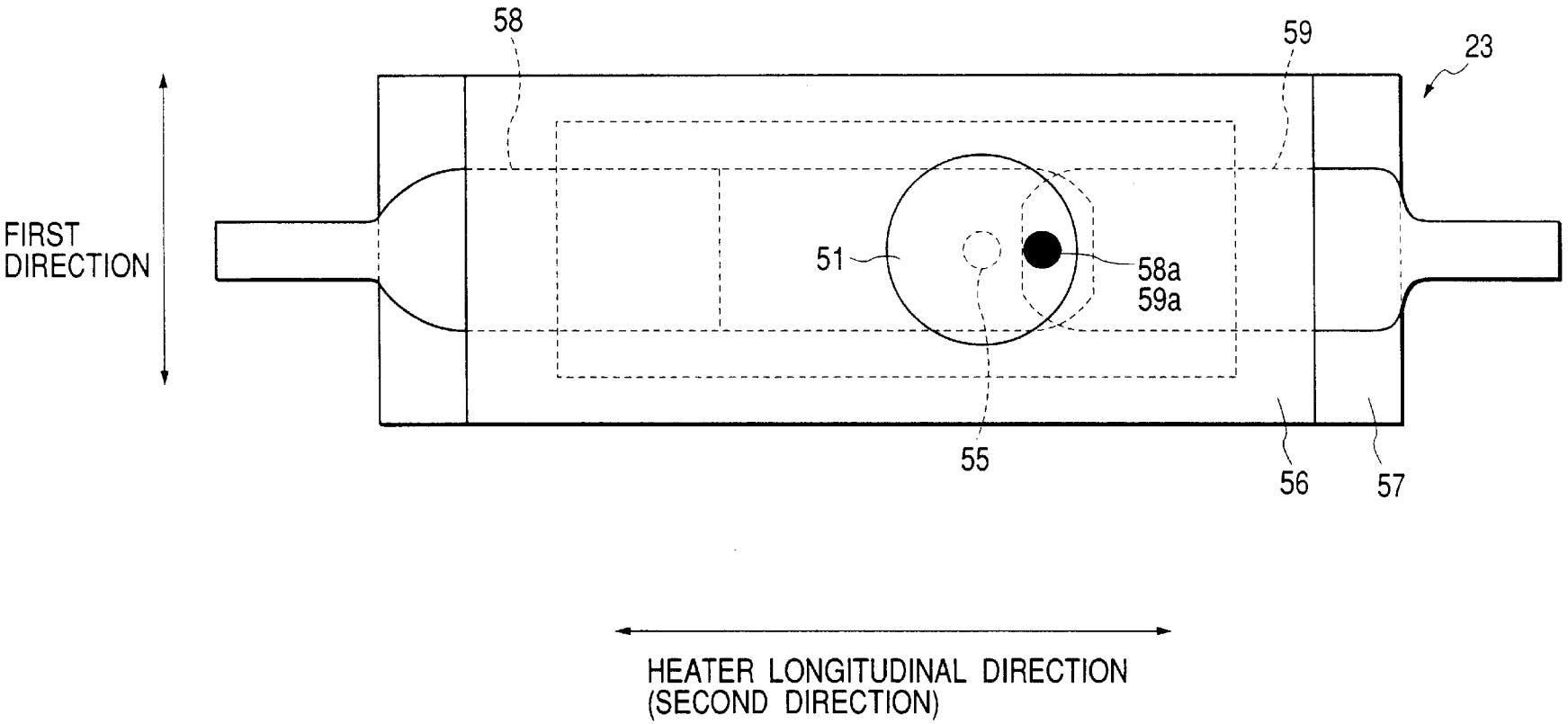
FIG. 8 is a bottom view of the thermostat according to the present invention.
Figure 9:
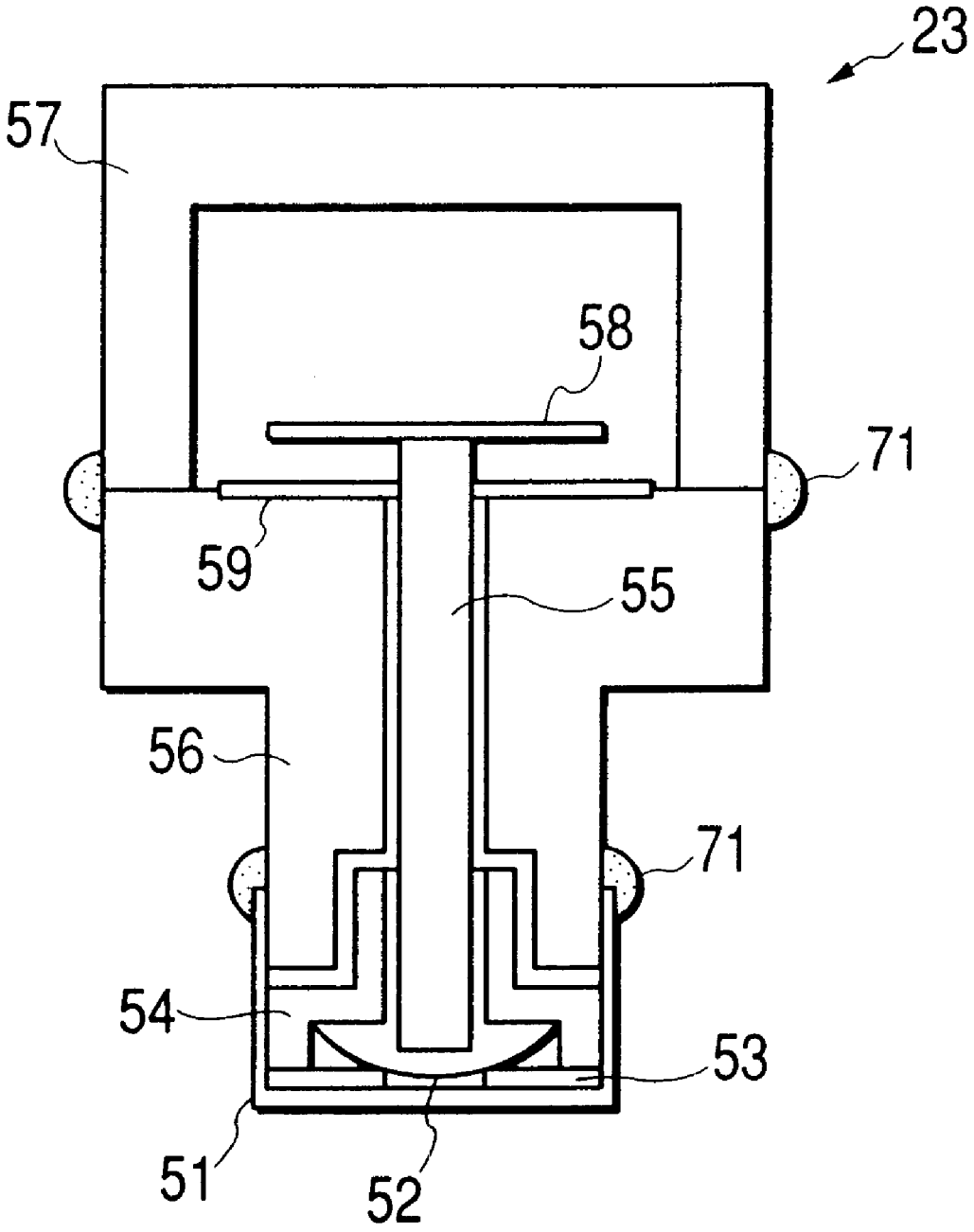
FIG. 9 is a cross-sectional view of the thermostat taken along the line IX—IX in FIG. 7.
Figure 10:
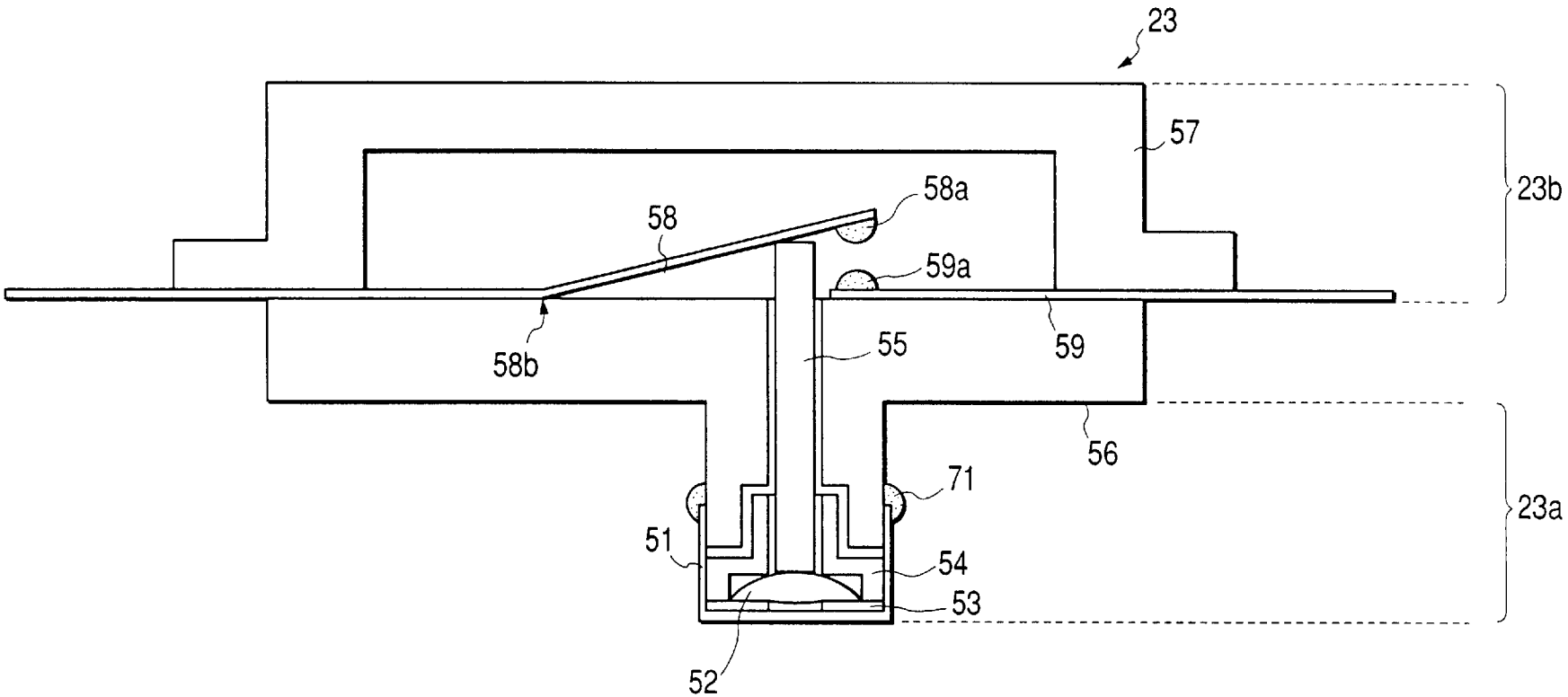
FIG. 10 is a diagram showing the state wherein the contact points of the thermostat are open.

The structure of the thermostat 23 according to the present invention will now be described while referring to FIGS. 7 to 10. FIGS. 7 and 10 are side cross-sectional views of the thermostat 23, FIG. 8 is a bottom view of the thermostat 23, and FIG. 9 is a cross-sectional view taken along the line IX—IX in FIG. 7.

In the thermostat 23, an inner lid 54 is held by an insulating base member 56, and a bimetal 52 is supported by the inner lid 54. A cap 51 is attached to the base member 56 so as to cover the bimetal 52. Also, a washer 53 is inserted between the bimetal 52 and the cap 51 to hold the convex shape of the bimetal 52. A movable terminal 58 and a fixed terminal 59 are held on the base member 56 and constitute contact points 58*a* and 59*a* capable of opening and closing. The contact point 58*a,* at one longitudinal end of the movable terminal 58, pivots at a fulcrum 58*b.*

A cover 57 is attached to the base member 56 so as to protect the contact points 58*a* and 59*a* to cover the contact points 58a and 59*a.* A guide pin 55 is provided on the base member 56 to open and close the contact points 58*a* and 59*a* while interacting with the reversal movement of the bimetal 52. In addition, a sealing agent 71 is used to tightly close the base member 56 and the cover 57 in order to protect the contact points 58a and 59*a.* The sealing agent 71 can be eliminated in accordance with the requirements imposed by the environment in which employed.

As is described above, a temperature detecting portion 23*a* is constituted by the bimetal 52, the cap 51 and the like, and an opening/closing portion 23*b* is constituted by the movable terminal 58, the fixed terminal 59, the cover 57 and the like.

When viewed in the direction in which the temperature detection portion 23*a* and the opening/closing portion 23*b* are opposed to each other, the outer shape of the opening/closing portion 23*b* is substantially oblong, and the outer shape of the temperature detecting portion 23*b* is circular or substantially circular. The opening/closing portion 23*b* is extended long in the longitudinal direction of the ceramic heater 109*c.*

The cap 51 has a thermosensitive face, which contacts the face of the insulating substrate 31 or the face of the protective layer 34 of the ceramic heater 109*c.* When, due to a malfunction at the power supply means, a thermal runaway occurs at the heat generating body 3 or 20 and the temperature at the thermostat 23 reaches a predetermined temperature or more, the bimetal 52 is reversed to push the guide pin 55 upward, and a predetermined pressure is exerted on the movable terminal 58. By exerting pressure on the movable terminal 58, the contact point 58a of the movable terminal 58 is separated from the contact point 59*a* of the fixed terminal 59, the conduction between the movable terminal 58 and the fixed terminal 59 is opened, and the supply of power to the heat generating body 3 or 20 is cut (see FIG. 10).

In this embodiment, as is shown in FIGS. 7 to 10, the member close to the thermosensitive portion, i.e., the cap 51, the bimetal 52, the inner lid 54 and the washer 53, are circular or substantially circular, and the base member 56, which holds and protects the contact points 58*a* and 59*a,* and the cover 57 are substantially oblong. The sizes of the base member 56 and the cover 57 in the first direction, i.e., in the direction perpendicular to the longitudinal direction of the ceramic heater 109*c,* are substantially equal to the sizes of the bimetal 52, the washer 53, the cap 51 and the inner lid 54 in the first direction. In this embodiment, the base member 56 and the cover 57 are slightly greater than the bimetal 52, the washer 53, the cap 51 and the inner lid 54. The sizes of the base member 56 and the cover 57 in the second direction, perpendicular to the first direction, are set sufficiently greater than the sizes of the bimetal 52, the washer 53, the cap 51 and the inner lid 54 in the direction.

That is, the length in the longitudinal direction of the opening/closing portion 23*b* is greater than that of the temperature detecting portion 23*a* in the direction.

Incidentally, the width of the temperature detecting portion 23*a* in the direction perpendicular to the longitudinal direction of the heater is smaller than that of the heater in the direction.

With the above arrangement, the thermosensitive portion constituting the temperature detecting portion can be compactly made, and the portion (opening/closing portion) that constitutes the contact points can be elongated. Since a small thermosensitive portion is provided, the thermal responsibility of the thermostat 23 can be improved, and since the portion that constitutes the contact point is elongated, the stroke of the movable terminal 58 can be increased, as can the contact reliability of the contact point can be increased.

Further, since the thermosensitive portion is small and the base member 56 and the cover 57 are both long, the thermostat 23 can be easily abutted within the width of the insulating substrate 31 of the ceramic heater 109*c*, which is also small in width direction.

When the thermosensitive portion, i.e., the cap 51, the inner lid 54 and the washer 53 are formed of a material, such as aluminum, that has great thermal conductivity and the base member 56 and the cover 57 are formed of a material, such as ceramic, that has a thermal conductivity smaller than that of aluminum, the heat received by the face of the cap 51 as the thermosensitive face is transmitted via the washer 53 or the inner lid 54 to the bimetal 52. Since the thermal conductivity of the base member 56 is small, heat seldom escapes to the base member 56, and the thermal transmission efficiency to the bimetal 52 is increased, thereby improving the thermal responsibility of the thermostat 23.

In the above embodiment, when the base member 56 is made of a material, such as steatite, for which thermal conductivity is extremely small, the amount of heat that escapes to the base member 56 is greatly reduced. Further, a material, such as alumina, having a thermal conductivity that is greater than that of the base member 56 and that is smaller than that of metal, or a material having a thermal conductivity that is higher than that of the base member 56 can be employed for the cover 57. As a result, the thermal responsibility of the thermostat 23 can be enhanced, and the degree of freedom afforded in the selection of available material increased.

Although in the above embodiment a ceramic heater has been employed, the substrate for the heater is not limited to a ceramic one, and a metal plate, such as SUS, on which an insulating layer is deposited can also be employed.

As is described above, according to the present invention, since the movable terminal of the opening/closing portion can be elongated, even a small displacement of the guide pin can certainly open and close the contact points of the movable terminal and the fixed terminal. Further, since the degree to which the movable terminal is bent at the fulcrum can be reduced, the opening/closing of the movable terminal can be effected certainly.

While the present invention was explained in connection with the embodiments thereof, the present invention is not limited to the embodiments, but various modifications can be made within the technical idea of the present invention.

What is claimed is:

1. A thermostatic device comprising:

a temperature detecting portion for detecting temperature, said temperature detecting portion including a bimetal and a heat conductive cap for covering said bimetal; and an opening/closing portion for opening and closing an electric contact point in accordance with an operation of said temperature detecting portion, said opening/closing portion including a movable terminal and a fixed terminal, wherein said opening/closing portion is extended long, and a length of said movable terminal in a longitudinal direction is greater than a length of said heat conductive cap in the longitudinal direction.

2. A thermostatic device according to claim 1, wherein said opening/closing portion includes a cover for covering said movable terminal and said fixed terminal, wherein a length of said cover in the longitudinal direction is greater enough than the length of said heat conductive cap in the longitudinal direction.

3. A thermostatic device according to claim 2, wherein, in a longitudinal direction, one end of said movable terminal pivots at a fulcrum.

4. A thermostatic device according to claim 2, wherein, viewed in a direction in which said opening/closing portion and said temperature detecting portion are opposed to each other, an outer shape of said opening/closing portion is substantially oblong and an outer shape of said temperature detecting portion is circular or substantially circular.

5. A thermostatic device according to claim 2, further comprising a pin for transmitting a movement of said bimetal to said movable terminal.

6. A thermostatic device according to claim 2, further comprising a base member for supporting said opening/closing portion and said temperature detecting portion.

7. A thermostatic device according to claim 6, wherein said base member has a lower thermal conductivity than that of said temperature detecting portion.

8. A heating apparatus comprising:

a heater including a long base member and heat generating element, provided on said base member, generating heat by being supplied power; and a thermostatic device for cutting supplying power to said heater when temperature rises excessively;

wherein said thermostatic device includes a temperature detecting portion for detecting temperature, said temperature detecting portion includes a bimetal and a heat conductive cap for covering said bimetal, and an opening/closing portion for opening and closing an electric contact point in accordance with an operation of said temperature detecting portion, said opening/closing portion including a movable terminal and a fixed terminal; and wherein said opening/closing portion is extended long, and a length of said movable terminal in a longitudinal direction is greater than a length of said heat conductive cap in the longitudinal direction.

9. A heating apparatus according to claim 8, wherein said thermostatic device contacts said heater, wherein said opening/closing portion is extended long in a longitudinal direction of said heater, and wherein, in a direction perpendicular to the longitudinal direction of said heater, a width of said temperature detecting portion is smaller than a width of said heater.

10. A heating apparatus according to claim 8, wherein said opening/closing portion includes a cover for covering said movable terminal and said fixed terminal, wherein a length of said cover in the longitudinal direction is greater enough than the length of said heat conductive cap in the longitudinal direction.

11. A heating apparatus according to claim 10, wherein, in a longitudinal direction, one end of said movable terminal pivots at a fulcrum.

12. A heating apparatus according to claim 10, wherein, viewed in a direction in which said opening/closing portion and said temperature detecting portion are opposed to each other, an outer shape of said opening/closing portion is substantially oblong and an outer shape of said temperature detecting portion is circular or substantially circular.

13. A heating apparatus according to claim 10, further comprising a pin for transmitting a movement of said bimetal to said movable terminal.

14. A heating apparatus according to claim 10, further comprising a base member for supporting said opening/closing portion and said temperature detecting portion.

15. A heating apparatus according to claim 14, wherein said base member has a lower thermal conductivity than that of said temperature detecting portion.

16. A fixing apparatus comprising:

a heater including a long base member, and heat generating element, provided on said base member, generating heat by being supplied power;

a film sliding with said heater; and wherein an unfixed image is fixed on a recording material by heat from said heater via said film, a thermostatic device for cutting supplying power to said heater when temperature rises excessively;

wherein said thermostatic device includes a temperature detecting portion for detecting temperature, said temperature detecting portion includes a bimetal and a heat conductive cap for covering said bimetal, and an opening/closing portion for opening and closing an electric contact point in accordance with an operation of said temperature detecting portion, said opening/closing portion including a movable terminal and a fixed terminal; and wherein said opening/closing portion is extended long, and a length of said movable terminal in a longitudinal direction is greater enough than a length of said heat conductive cap in the longitudinal direction.

17. A fixing apparatus according to claim 16, wherein said heater is extended long in a direction perpendicular to a direction in which said film is moved.

18. A fixing apparatus according to claim 16, wherein said thermostatic device contacts said heater, wherein said opening/closing portion is extended long in a longitudinal direction of said heater, and wherein, in a direction perpendicular to the longitudinal direction of said heater, a width of said temperature detecting portion is smaller than a width of said heater.

19. A fixing apparatus according to claim 16, wherein said opening/closing portion includes a cover for covering said movable terminal and said fixed terminal, wherein a length of said cover in the longitudinal direction is greater enough than the length of said heat conductive cap in the longitudinal direction.

20. A fixing apparatus according to claim 19, wherein, in a longitudinal direction, one end of said movable terminal pivots at a fulcrum.

21. A fixing apparatus according to claim 19, wherein, viewed in a direction in which said opening/closing portion and said temperature detecting portion are opposed to each other, an outer shape of said opening/closing portion is substantially oblong and an outer shape of said temperature detecting portion is circular or substantially circular.

22. A fixing apparatus according to claim 19, further comprising a pin for transmitting a movement of said bimetal to said movable terminal.

23. A fixing apparatus according to claim 19, further comprising a base member for supporting said opening/closing portion and said temperature detecting portion.

24. A fixing apparatus according to claim 23, wherein said base member has a lower thermal conductivity than that of said temperature detecting portion.

* * * * *

UNITED STATES PATENT AND TRADEMARK OFFICE

CERTIFICATE OF CORRECTION

PATENT NO. : 6,516,164 B1
DATED : February 4, 2003
INVENTOR(S) : Takao Kawazu

It is certified that error appears in the above-identified patent and that said Letters Patent is hereby corrected as shown below:

Column 1,
Line 24, “mad e” should read -- made --.

Signed and Sealed this

Seventh Day of October, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,516,164 B1
DATED : February 4, 2003
INVENTOR(S) : Takao Kawazu

It is certified that error appears in the above-identified patent and that said Letters Patent is hereby corrected as shown below:

Column 1,
Line 24, “mad e” should read -- made --.

Signed and Sealed this

Twenty-first Day of October, 2003

JAMES E. ROGAN
*Director of the United States Patent and Trademark Office*